United States Patent [19]

Odermann et al.

[11] Patent Number: 4,481,897

[45] Date of Patent: Nov. 13, 1984

[54] CLUTCHING ARRANGEMENT FOR A SEWING MACHINE BOBBIN

[75] Inventors: Charles R. Odermann, Montville; Robert H. Larsen, Middletown, both of N.J.

[73] Assignee: The Singer Company, Stamford, Conn.

[21] Appl. No.: 505,009

[22] Filed: Jun. 16, 1983

[51] Int. Cl.[3] ..... D05B 57/26; D05B 59/00

[52] U.S. Cl. ..... 112/279; 112/184

[58] Field of Search ..... 112/184, 279; 192/35, 192/93 A; 411/403, 404, 410

[56] References Cited

U.S. PATENT DOCUMENTS

| | | | |
|---|---|---|---|
| 391,097 | 10/1888 | Thayer | 411/403 |
| 1,855,697 | 4/1932 | Sullivan | 192/93 A X |
| 1,894,034 | 1/1933 | Fieg | 411/410 |
| 2,258,326 | 10/1971 | Holt | 411/404 |
| 3,675,694 | 7/1972 | Barlow | 411/403 X |
| 3,808,937 | 5/1974 | Roehrig | 411/407 |
| 4,084,478 | 4/1978 | Simmons | 411/404 |
| 4,089,357 | 5/1978 | Gill | 411/404 X |
| 4,228,723 | 10/1980 | Cunningham | 411/394 X |
| 4,355,552 | 10/1982 | Gutshall | 411/404 X |
| 4,397,250 | 8/1983 | Zylbert et al. | 112/184 |

FOREIGN PATENT DOCUMENTS

| | | | |
|---|---|---|---|
| 284524 | 11/1971 | U.S.S.R. | 192/93 A |

OTHER PUBLICATIONS

U.S. Appln. Ser. No. 381,268, Filed May 24, 1982—"-Sewing Machine Bobbin for a Vertical Axis Hook"—C. R. Odermann and T. Zylbert.

*Primary Examiner*—Wm. Carter Reynolds

*Attorney, Agent, or Firm*—William V. Ebs; Robert E. Smith; Edward L. Bell

[57] ABSTRACT

A clutch which is engaged to rotate and wind thread on a sewing machine bobbin is provided with clutch parts that include a single bladed paddle, and a member with a pair of crossed paddle receiving through slots, one of which has a chamfered upper edge that substantially widens the mouth of the slot and the other of which is without such chamfered edge.

5 Claims, 3 Drawing Figures

CLUTCHING ARRANGEMENT FOR A SEWING MACHINE BOBBIN

BACKGROUND OF THE INVENTION

1. Field of the Invention

The invention relates to sewing machine bobbins, and more particularly to clutching arrangements for operably connecting a bobbin to bobbin winding mechanism.

2. Description of the Prior Art

Mechanism for use in replenishing thread on a bobbin while in place in the vertical axis looptaker of a sewing machine are well know. Such mechanism, of which that shown in U.S. Pat. No. 4,326,474 of Thaddeus Z. Zylbert for "In-Place Bobbin Winding Mechanism for a Sewing Machine", issued Apr. 27, 1982, is an example, includes clutching means through which the bobbin must be rotated to cause thread to be wound on the bobbin by a drive shaft. However, the clutching means in such mechanism will sometimes fail to function properly due to misalignment of the clutch parts occasioned, for example, by an off-center shift of a clutch part in a bobbin, of the bobbin within a bobbin case, or of the bobbin case within a looptaker.

It is a prime object of the invention to provide an improved clutch which is operable to effectively connect a bobbin to bobbin winding mechanism in a sewing machine even when the clutch parts are misaligned.

It is another object of the invention to provide a self-aligning clutch arrangement for operably connecting a bobbin to bobbin winding mechanism in a sewing machine.

Other objects and advantages of the invention will become apparent during a reading of the specification taken in connection with the accompanying drawings.

SUMMARY OF THE INVENTION

Figure 1:
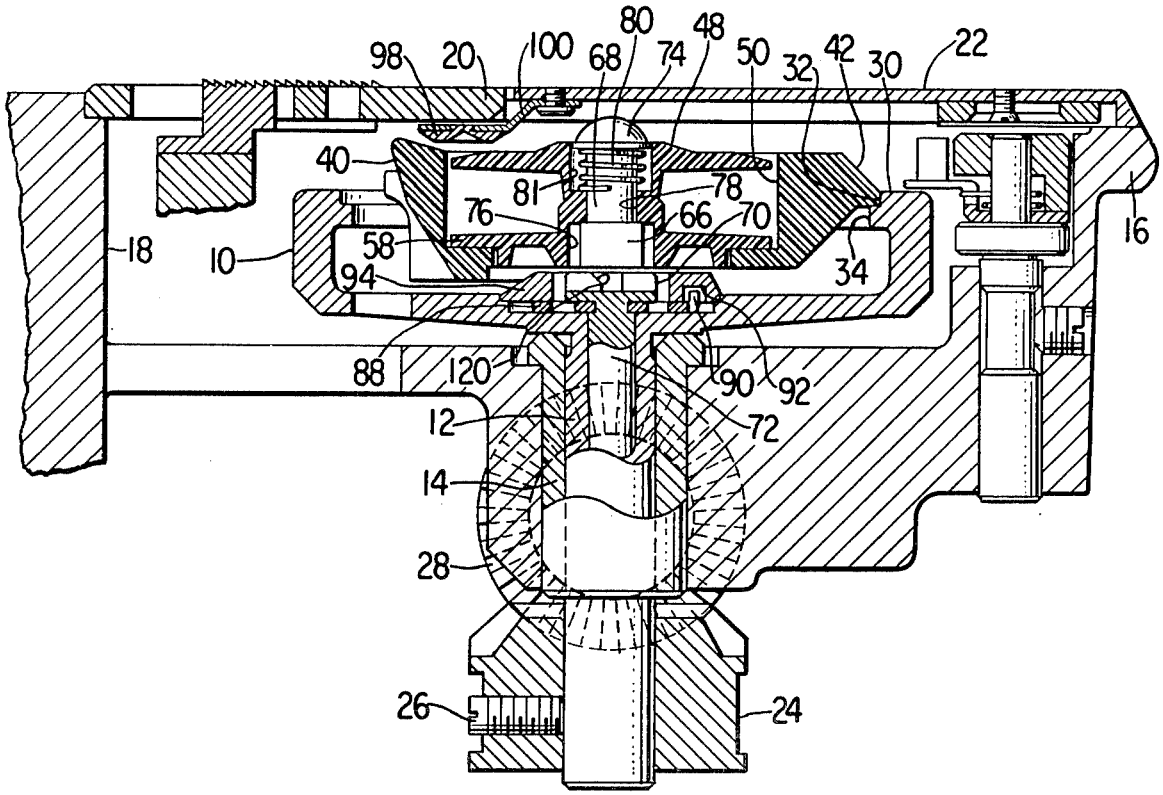
FIG. 1 is a fragmentary, vertical, sectional view taken through the bed of a sewing machine at a looptaker and showing the construction of the invention.

A clutching arrangement according to the invention includes a first clutch part which is rotationally fixed in a sewing machine bobbin, and a rotatable second part for imparting rotation to the first part and thereby to the bobbin during a bobbin winding operation. The clutch is engaged by axial movement of one such clutch part despite misalignment of the parts due, for example, to tolerance build up and play in the clutch parts and associated mechanism. One of the clutch parts includes a single bladed paddle, and the other includes a pair of paddle receiving slots which extend perpendicular to the rotational axis of the part and perferably to each other. The slots have side walls in planes parallel to said axis, and one of the slots, but not the other, has a longitudinally extending upper edge chamfered at an angle effective to substantially widen the mouth of the slot.

Assuming misalignment between the clutch parts with both the central plane of the paddle and a line perpendicular thereto through the axis of the paddle relatively offset with respect to the axis of the slotted part, the clutch parts are nevertheless caused to operably connect with one another when actuated for engagement during rotation of one of the clutch parts. The paddle temporarily enters the chamfered slot by way of the angled upper edge of the slot and a relative adjustment of the clutch parts is effected, eliminating the offset between the plane of the paddle and axis of the slotted part. The paddle is then cammed out of the chamfered slot by the said angled upper edge and caused to enter the other slot. Rotational forces cause the clutch parts to finally adjust in the unchamfered slot and bring the axes of the paddle and slotted part into alignment wherein they remain during the continuance of a bobbin winding operation.

DESCRIPTION OF THE PREFERRED EMBODIMENT OF THE INVENTION

Referring to the drawings, reference character 10 designates the looptaker of a sewing machine. As shown, the looptaker includes as an integral part thereof, a hollow shaft 12 which is journalled in a bushing 14. The bushing is carried in a sewing machine bed 16, which is formed with an upwardly open looptaker accommodating cavity 18. A throat plate 20 partially covers the cavity and a slide plate 22 is movable over the remaining portion of the opening. Turning movement is imparted in one direction during operation of the sewing machine to the looptaker 10 by a bevel gear 24 made fast to the looptaker shaft by a set screw 26 and in mesh with a bevel gear 28 on a driving shaft (not shown).

The looptaker 10 is cupshaped and includes a rim 30 with an upwardly extending bearing shoulder 32 and an annular inwardly extending bearing rib 34. Rib 34 is formed with a thread loop seizing beak 36 on one side of a lateral opening 38. Constrained within the cupshaped looptaker is a bobbin case 40. Externally the bobbin case is formed with a bearing flange 42 which rests upon the bearing rib 34 of the looptaker and is constrained radially against the bearing shoulder 32. Rotational and upward movement of the bobbin case is prevented with bobbin case engaging means (not shown), which is affixed to the bed 16. Such means may be such as disclosed, for example, in U.S. Pat. No. 4,326,474 of Thaddeus J. Zylbert for "In-Place Bobbin Winding Mechanism for a Sewing Machine", issued Apr. 27, 1982. The bobbin case has a thread tensioning device 44 of the kind shown in said patent secured thereon with a screw 46.

A bobbin 48 is rotatable within a cavity 50 in bobbin case 40. As shown, the bobbin includes a top flange 52 with an outwardly extending slot 54 for use during a bobbin winding operation. The bobbin further includes a bottom flange 56 with a protruding annulus 58 which rests upon an annular base 60 of the bobbin case, and a depending boss 61 which extends into a bobbin case aperture 62.

Bobbin 48 may be wound with thread in the manner fully described in the aforesaid U.S. Pat. No. 4,326,474, as the bobbin is rotated by looptaker 10. A clutch in accordance with the invention serves to operably connect the bobbin to the looptaker for bobbin winding. Such clutch includes a single bladed paddle 66 at the end of a plunger 68 which is mounted in bobbin 48, and a slotted part 70 at the end of a stub shaft 72 which is piloted in hollow looptaker shaft 12. The plunger includes an enlarged screw-on cap 74 at the top end.

Paddle 66 is slidable in an accommodating slot 76 in the bobbin, and plunger 68 is slidable in a central bobbin aperture 78. A biasing spring 80 surrounding plunger 68, under cap 74, and located in a deep recess 81 in the bobbin urges the plunger upwardly to a raised position in which the upper end of paddle 66 engages the upper end of bobbin slot 76. Stub shaft 72 is frictionally engaged in an annulus 82 by the end portions 84 and 86 of a spring clutch member 88 having a tang 90 thereon which extends into a slot 92 in a member 94 affixed to the looptaker with a screw 96, and which thereby establishes a driving connection between looptaker 10 and slotted clutch part 70 through member 88.

A cam 98 on a resilient member 100, which is affixed to slide plate 22, is engagable in a partially open position of the plate with plunger cap 74 and is then effective to urge plunger 68 downwardly in the bobbin against upwardly biasing spring 80. The downward urging of plunger 68 by cam 98 in the partially open position of plate 22 during rotation of slotted clutch part 70 of the looptaker results in the establishment of a driving connection between clutch part 70 and paddle 66, and rotation of the bobbin 48 by the paddle as required for bobbin winding.

A driving connection is established between slotted clutch part 70 and the other clutch part, namely paddle 66, despite misalignment of the central rotational axes 102 and 104 of slotted part 70 and paddle 66, respectively, due, for example, to tolerance build up and play in the clutch parts and associated mechanism. Such driving connection is assured by reason of the construction of clutch part 70, which as shown, is formed in end face 106 with mutually perpendicular crossed slots 108 and 110. The slots are through slots, that is they extend completely across face 106 and are therefor without end walls. The slots are of equal width at the base and have parallel sides 112, 114 and 116, 118. However, one slot 108 has a chamfered upper edge 120 which is angled to substantially widen the mouth of the slot. The width of paddle 66 is slightly less than the distance between the parallel side walls of the slots.

Figure 3:
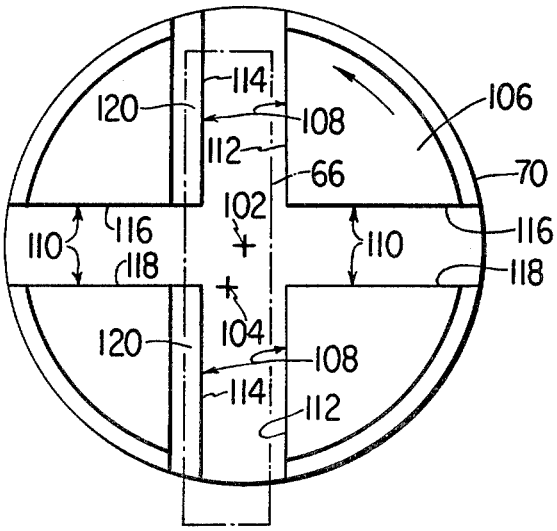
FIG. 3 is an enlarged somewhat diagrammatic plan view illustrating the relationship between coacting parts of the clutch.
Figure 2:
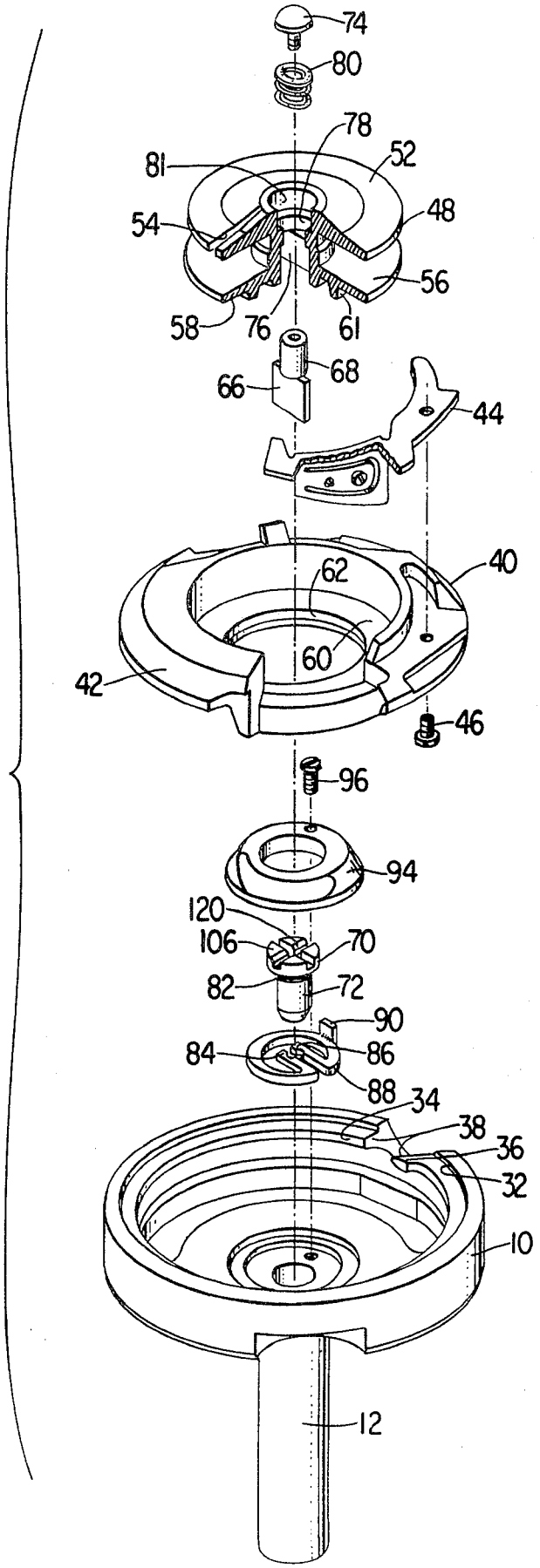
FIG. 2 is an exploded perspective view showing the said looptaker, a bobbin case, a bobbin, and a clutch according to the invention.

Clutch parts 66 and 70 operably connect although the axes 102 and 104 are misaligned. When clutch part 70 has been rotated to a position wherein paddle 66 is parallel to slot 108, but nevertheless axially displaced relative thereto in a position in which one longitudinal edge of the paddle is over chamfered edge 120 of slot 108 and the other edge is over the deeper portion of the slot (see FIG. 3), the paddle is caused to slide on edge 120 into the slot and while so doing the clutch parts relatively adjust to eliminate the offset between the central plane of the paddle and central plane between sides 112 and 114 of slot 108. The paddle is only temporarily in slot 108 since it is quickly cammed out of the slot by and over angled edge 120, and caused to enter unchamfered slot 110. Rotational forces cause the clutch parts to finally adjust in slot 110 and bring the axes 102 and 104 of the slotted part and paddle into alignment wherein they remain throughout the bobbin winding operation.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the sprit and scope of the invention are intended to be included within the scope of the appended claims.

We claim:

1. In combination, a sewing machine bobbin, a first clutch part rotationally affixed in the bobbin, a rotatable second clutch part for rotating the first part and thereby the bobbin, the first or second part being axially movable for operably connecting the said parts, one of the clutch parts including a single bladed paddle and the other clutch part including a pair of crossed paddle receiving through slots which extend perpendicular to the rotational axis of the part, the crossed slots having side walls which are parallel to said axis, and one slot, but not the other having a longitudinally extending upper edge chamfered at an angle effective to substantially widen the mouth of the slot.

2. The combination of claim 1 wherein the crossed slots are mutually perpendicular.

3. The combination of claim 1 wherein the axially movable part is spring biased in a direction away from the other part and is movable in the opposite direction for operably connecting the said parts.

4. The combination of claim 1 wherein the axially movable part is said first clutch part.

5. The combination of claim 4 wherein the first clutch part includes the paddle.

* * * * *